United States Patent [19]

Atkinson

[11] Patent Number: 4,717,409

[45] Date of Patent: Jan. 5, 1988

[54] LIQUID VAPOR CONTACT METHOD AND APPARATUS

[75] Inventor: Timothy D. Atkinson, London, England

[73] Assignee: The BOC Group plc, Windlesham, England

[21] Appl. No.: 861,952

[22] Filed: May 12, 1986

[30] Foreign Application Priority Data

May 17, 1985 [GB] United Kingdom ..... 8512562

[51] Int. Cl.[4] ..... F25J 3/04

[52] U.S. Cl. ..... 62/22; 62/29; 62/34; 62/42

[58] Field of Search ..... 62/11, 22, 23, 24, 29, 62/32, 34, 36, 42

[56] References Cited

U.S. PATENT DOCUMENTS

| | | | |
|---|---|---|---|
| 2,548,508 | 4/1951 | Wolfner . | |
| 2,667,764 | 2/1954 | Turner . | |
| 4,022,030 | 5/1977 | Brugerolle | 62/30 |
| 4,433,989 | 2/1984 | Erickson | 62/42 X |
| 4,453,957 | 6/1984 | Pahade et al. | 62/29 X |
| 4,578,095 | 3/1986 | Erickson | 62/22 |
| 4,604,116 | 8/1966 | Erickson | 62/22 X |
| 4,604,117 | 8/1986 | Cheung | 62/34 X |

FOREIGN PATENT DOCUMENTS 136926A 4/1985 European Pat. Off. .

*Primary Examiner*—Albert J. Makay
*Assistant Examiner*—Steven E. Warner
*Attorney, Agent, or Firm*—R. Hain Swope; Chris P. Konkol; Larry R. Cassett

[57] ABSTRACT

In a process for the separation of argon from a gaseous mixture comprising argon, nitrogen and oxygen by fractional distillation in a plurality of distillation zones, first and second fluid streams comprising nitrogen and oxygen, respectively, drawn from the same or different distillation zones, are introduced into different regions of a liquid-vapor contact and mixing zone. There is established in the contact and mixing zone a liquid flow that becomes progressively richer in nitrogen and a vapor flow that becomes progressively richer in oxygen. A mixed waste stream containing both oxygen and nitrogen is withdrawn from an intermediate point in the contact and mixing zone thereby enhancing its efficiency. Vaporous oxygen from the warmer end of the contact and mixing zone is condensed and returned to the mixing zone to enhance its reflux and/or may be passed into a distillation zone. The fluid in the contact and mixing zone may be utilized therein or in the distillation zone for heating or refrigeration through heat transfer.

15 Claims, 5 Drawing Figures

LIQUID VAPOR CONTACT METHOD AND APPARATUS

This invention relates to a method and apparatus for contacting liquid and vapour. In particular, it relates to a method and apparatus for separating argon from a gas mixture comprising argon, oxygen and nitrogen. Typically, such a gas mixture is formed by extracting relatively low volatility impurities such as water vapour and carbon dioxide from air.

BACKGROUND OF THE INVENTION

Traditionally, in separating air, if argon is to be obtained as a product gas, the incoming air is separated into relatively pure streams of oxygen, nitrogen and argon. The ideal thermodynamic work involved in such a separation is 14.5 KCal/SM$^3$. Since air contains less that 1% by volume of argon, this traditional 'total-split' air separation technology is particularly inefficient if argon is the only desired product. The ideal thermodynamic work of a process for separating air into an argon stream and an oxygen-nitrogen mixture is only 1.2 KCal/SM$^3$.

In order to improve the efficiency of argon recovery, we believe that it is desirable to separate air into oxygen, nitrogen and argon in a conventional distillation system operating at cryogenic temperatures, but to remix the oxygen and nitrogen so as to recover the work of mixing typically in the form of heat pump duty for the distillation system. We have found that the overall efficiency in terms of argon production of such a process is highly dependent upon the efficiency with which the mixing is performed.

European patent application No. 136 926A relates to the operation of a conventional double column with argon "side-draw" for producing nitrogen, oxygen and argon products. It is the object of the invention disclosed in that European patent application to take advantage of a temporary fall in the oxygen demand in order to increase one or more of the other products, for example argon. A liquid is thus taken from one of the two columns forming the double column and is passed to the top of an auxiliary or mixing column operating at substantially the pressure of the low pressure column. A gas whose oxygen content is less than that of the liquid that is taken from the low pressure column is passed to the bottom of the auxiliary column. The liquid collected at the bottom of the auxiliary column is passed as reflux into the low pressure column substantially at the level from where the said gas is taken. As more oxygen-rich liquid is taken from the double column and passed to the auxiliary column so more reflux may be provided for the low pressure column, thereby making possible an increase in the rate of argon production. However, this method involves substantial inefficiencies which makes it unsuitable for use in a plant for producing argon as the primary or sole product of air separation. In particular, the only heat extracted from the top of the column is that in a waste stream comprising oxygen and nitrogen that is vented from the top of the mixing or auxiliary column. In addition the amount of liquid oxygen that can be added to the top of the column is restricted by the need for a mass balance with the oxygen vented in the waste stream. Accordingly, the amount of heat pumping duty that can be performed is limited. Moreover, by rejecting the waste stream comprising oxygen and nitrogen from the top of the column it is inevitable that at least in some parts of the column the operating conditions will diverge substantially from equilibrium conditions with a concomitant loss of thermodynamic efficiency. If the liquid introduced into the top of the mixing column is pure oxygen, the divergence will be particularly marked, while if the liquid contains argon there will also be an appreciable fall in the argon yield from the plant.

It is an aim of the invention to provide an improved method and apparatus for separating argon from a gas mixture comprising argon, nitrogen and oxygen.

SUMMARY OF THE INVENTION

According to the present invention there is provided a process for the separation of argon from a gaseous mixture comprising argon, nitrogen and oxygen by fractional distillation, which includes the step of mixing fluids and recovering some of the work of mixing, comprising introducing a first fluid stream comprising at least one relatively volatile component and a second fluid stream comprising at least one less volatile component into different regions of a liquid-vapour contact and mixing zone, establishing through the zone a flow of liquid that becomes in the direction of its flow progressively richer in the relatively volatile component through mass exchange with an opposed flow of vapour that becomes in the direction of vapour flow progressively richer in the less volatile component, withdrawing a mixed waste stream containing both said components from the zone, and employing fluid in or from the zone to perform heating or cooling duty (or both) for the distillation of the said gaseous mixture, whereby some of the work of mixing is recovered, wherein said first and second fluid stream pass to said liquid-vapour contact zone from the same or different distillation zones, said at least one relatively volatile component being nitrogen and said at least one less volatile component being oxygen, wherein a product stream comprsing argon is recovered from said at least one of the distillation zones and wherein (a) a third fluid stream comprising vaporous oxygen passes from the warmer end region of the said mixing zone to at least one of the distillation zones and/or (b) vaporous oxygen is condensed in a condenser associated with said warmer end region and condensate is returned to the mixing zone.

DETAILED DESCRIPTION OF THE INVENTION

Figure 1:
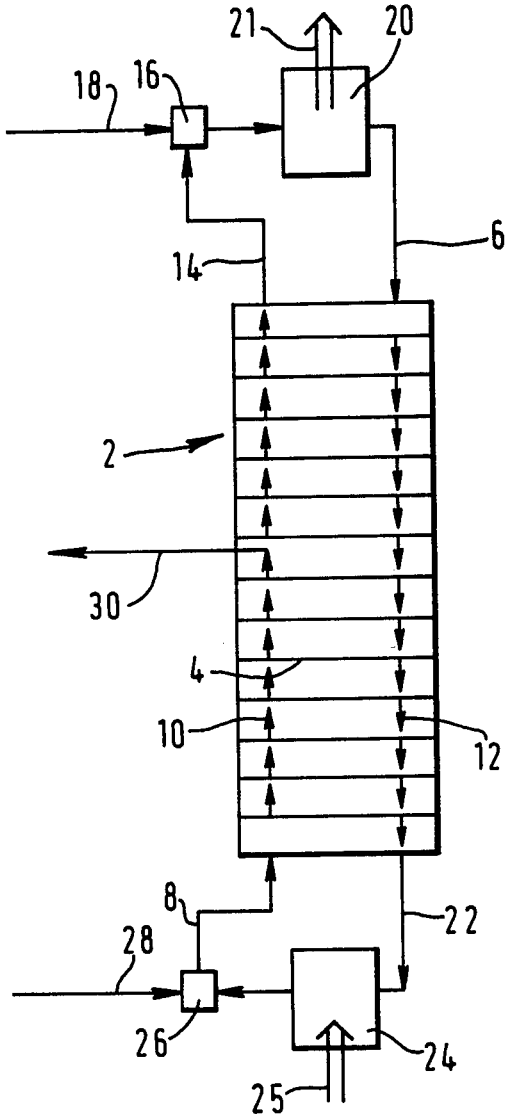
FIG. 1 is a schematic diagram illustrating a mixing column capable of functioning as a heat pump and forming part of an apparatus according to the invention.

The present invention provides an improved process for the separation of argon from a gaseous mixture and apparatus therefor.

For performing such method, the invention provides apparatus including means defining a liquid-vapour contact and mixing zone having a first inlet for a first fluid stream comprising said at least one relatively volatile component spaced from a second inlet for a second fluid stream comprising said at least one less volatile component, an outlet for the withdrawal of a mixed waste stream containing both said components, liquid-vapour contact means in said zone which enable there to be established through the zone a flow of fluid that becomes in the direction of liquid flow progressively richer in the said relatively volatile component through mass exchange with an opposed flow of vapour that becomes in the direction of vapour flow progressively richer in the said less volatile component, means defining a plurality of distillation zones, an inlet to at least one of said distillation zones for a gaseous mixture comprising oxygen, nitrogen and argon, an outlet for argon product from at least one of said distillation zones, means for employing fluid in or from said liquid-vapour contact zone to perform heating or cooling duty (or both) for the distillation of the said gaseous mixture, whereby some of the work of mixing that takes place in said mixing contact zone in operation of the apparatus is recovered, said first and second inlets to the liquid-vapour contact zone communicating with the said one or more of the distillation zones, whereby in operating said first and second fluid streams are able to pass to said mixing zone from at one or more of the distillation zones, and means for passing a third fluid stream comprising vaporous oxygen from the warmer end region of the said mixing zone to one of the distillation zones and/or a condenser, in association with the warmer end of said liquid-vapour contact zone, for condensing vaporous oxygen and for returning condensate to the mixing zone.

By the said return of condensed vaporous oxygen from the warmer end of the mixing zone, and/or by the withdrawal of a vaporous oxygen stream therefrom, the reflux to the mixing zone may be enhanced. An enhanced reflux makes it possible to enhance the heat pumping work that the mixing zone is capable of performing. The return of condensed vaporous oxygen directly increases the reflux to the mixing zone. The withdrawal of a vaporous oxygen stream to a distillation zone enhances the mass flow rate of oxygen out of the mixing zone and thus makes possible an increased flow of liquid oxygen reflux into the warmer end of the mixing zone while still maintaining a mass balance.

The aforesaid return of condensed vaporous oxygen to the warmer end of the mixing zone facilitates the maintenance of operating conditions in the mixing zone closer to equilibrium than when no such condensate is formed and returned. The said second fluid stream will generally be formed by taking relatively pure liquid oxygen from a distillation zone. The condensate is typically relatively impure liquid oxygen as it is formed from oxygen vapour that has passed to the warmer end of the mixing zone countercurrently to the liquid flow. The purity of the liquid oxygen that enters the warmer zone is thus reduced, and it is this reduction in purity that helps to maintain operating conditions in the mixing zone relatively close to equilibrium. A further improvement is made possible by withdrawing the said mixed waste stream from a region of the mixing zone intermediate its ends, when it becomes possible to maintain operating conditions within the mixing zone closer to equilibrium conditions than in an example in which the mixed waste stream is withdrawn from the warm end of the mixing zone. It is important in examples of the invention in which no condensate is returned to the warm end of the mixing zone that the mixed waste stream be withdrawn from such an intermediate level of the mixing zone. By maintaining operating conditions in the mixing zone closer to equilibrium conditions, the mixing of the oxygen and nitrogen can be achieved relatively efficiently such that a greater proportion of the work of mixing can be recovered in, for example, heat pumping duty for the distillation zones.

In some examples of the invention, the condenser associated with the warmer end of the mixing zone has a passge therethrough for the flow of heat exchange fluid flowing in a heat pumping circuit which provides re-boil for at least one of the distillation zones.

Typically, the second fluid stream is introduced into the mixing zone in the liquid state at its boiling point (under the prevailing conditions) or at a temperature just above such boiling point. The first fluid stream is typically introduced into the mixing zone in the vapour state at its condensation point (under the prevailing conditons) or a temperature just below such condensation point. The second stream is preferably in pure liquid oxygen and the first stream is preferably relative pure gaseous nitrogen.

Such streams are preferably introduced at the respective ends of the mixing zone (or column).

In some examples of the invention, liquid at the cold end of the mixing zone or column is boiled (in a boiler) in the column itself or outside the column. Reboil from the boiler is typically returned to the mixing column.

The condenser associated with the warm end of the mixing column may be situated in the column itself or outside the column.

The mixing zone may if desired be provided in the same column as a distillation zone, preferably with the mixing zone located above the distillation zone. In such an example of the invention, the incoming gaseous mixture of nitrogen, oxygen and argon is admitted to the distillation zone and the maximum nitrogen purity is achieved at an intermediate level in the column, the vapour ascending the column then becoming less pure as mixing takes place in the mixing zone.

The term 'waste stream' as referred to herein indicates a stream that is neither returned to the mixing zone nor to one of the distillation zones. The waste stream may have the same oxygen to nitrogen ratio as air, be produced at approximately atmospheric pressure (the mixing zone being operated at such pressure), and be vented to the atmosphere. Alternatively, a waste stream whose oxygen to nitrogen ratio is greater than that in air may be produced and supplied, for example, to a reactor in which a partial oxidation reaction is performed. In such an example, the waste stream is preferably produced at the pressure required for the reactor, e.g. a pressure from atmospheric pressure up to 12 atmospheres, and thus the mixing zone is operated at substantially such a pressure. If desired, a nitrogen product may be taken from the cold end of the mixing zone. If this nitrogen is impure, it may be purified in an auxiliary distillation column.

In preferred examples of the invention, the gaseous mixture of oxygen, nitrogen and argon is admitted to a single or double distillation column which produces oxygen at its bottom and nitrogen at its top and at an intermediate region a stream comprising oxygen and argon whose argon content is greater than that of the incoming gaseous mixture. The argon-rich stream is then preferably fractionated in a separate distillation column to produce a pure argon product. The mixing column takes liquid oxygen and gaseous nitrogen from the distillation column and is able to act as a heat pump transferring heat from a relatively cold part of the distillation system to relatively warm part. Some of the work of mixing the oxygen and nitrogen in the mixing column is thus recovered and helps to reduce the requirements of the distillation system for work from an external source. Thus, there is made possible an improvement in the overall efficiency of separation of argon (in terms of external power consumed per unit by volume argon produced).

Referring to FIG. 1 of the drawings, a heat pump based on the mixing of nitrogen (a relatively volatile fluid) with oxygen which has a lower volatility than nitrogen is illustrated. A column 2 includs a plurality of spaced, horizontal, liquid-vapour contact trays 4 which are arranged to permit liquid to flow down the column from tray to tray and to permit vapour to ascend the column, bubbling through the liquid on each tray. Liquid oxygen at its boiling point at the prevailing pressure is fed into the top of the column through an inlet 6. Vaporous nitrogen at its boiling point at the prevailing pressure is fed into the column 2 through an inlet 8 at its bottom. A flow of vapour up the column as indicated by thearrows 10 is established. An opposed flow of liquid down the column as indicated by the arrows 12 is also established. The flow of vapour up the column comes into intimate contact with the flow of liquid down the column: there is thus mass exchange between the two. Moreover, since the boiling point of nitrogen is appreciably below that of oxygen the vapour stream will tend to become warmer as it ascends the column and the liquid stream colder as it descends the column. Thus, the vapour becomes richer in oxygen as it is ascends the column and the liquid becomes richer in nitrogen as it descends the column. Typically at least 10 trays may be used. The composition of the vapour stream changes from relatively pure nitrogen at the bottom of the column to relatively pure oxygen at the top of the column and the composition of the liquid stream undergoes the converse change starting as relatively pure oxygen at the top of the column and finishing as relatively pure nitrogen at the bottom of the column.

Oxygen-rich vapour is withdrawn from the top of the column 2 through an outlet 14 and mixed in mixer 16 with a stream 18 of gaseous oxygen typically of a compsotion and temperature the same as or similar to the stream withdrawn through the outlet 14. The mixed stream is then passed into a condenser 20 provided with cooling means 21 and is condensed therein. The so-formed liquid is that introduced into the column 2 through the inlet 6. Analogously, nitrogen-rich liquid collecting at the bottom of the column 2 is withdrawn through the outlet 22 and is boiled in a reboiler 24 provided with heating means 25. The thus boiled nitrogen passes to a mixer 26 where it is mixed with an incoming stream of nitrogen vapour from a conduit 28. The stream passing through the conduit 28 typically has a composition and temperature the same as or similar to the stream from the reboiler 24 with which it is mixed. The resulting mixture forms the nitrogen-rich vapour that is introduced into the bottom of the column through the inlet 8.

The column 2 has an outlet 30 at a chosen level from which a part of the ascending vapour is withdrawn as a waste stream from the column. Alternatively a stream of liquid or liquid-vapour bi-phase may be withdrawn from the column through the outlet 30. The location of the outlet 30 may be chosen so that in the vapour that is withdrawn has the relative proportions of oxygen and nitrogen are the same as in air. The rate at which such "air" is withdrawn is chosen so as to maintain a mass balance with the incoming oxygen stream 18 and the incoming nitrogen stream 28.

Considering the operation of the reboiler 24 it will be appreciated that the nitrogen is extracting heat from the heating means 25 and thereby undergoing a phase change from liquid to vapour. In the condenser 20, however, heat is being extracted by the cooling means 21 from the gaseous oxygen in order to change its phase to the liquid state. Therefore, there is a flow of heat from the reboiler 24 to the condenser 20.

However, as liquid nitrogen boils at a lower temperature than that at which the oxygen condenses, heat is flowing from a relatively cold body to a relatively warm body. Thus, the heat is being "pumped", as, of course, heat tends naturally to flow in the reverse direction that is from a hot body to a cold body.

The liquid-vapour contact trays may be of any conventional type used in a distillation column. It is to be appreciated that instead of trays any conventional form of packing elements can be employed. Where trays are used, any conventional means may be employed for conducting liquid from the flow path at the end of one tray to the start of the flow path on the next lower tray.

The mixers 16 and 26 typically each comprise the union of two pipes.

Typically, the liquid oxygen stream 6 and the gaseous nitrogen stream 28 are taken from a distillation column.

The column 2 may be operated at atmospheric pressure or a pressure in excess of atmospheric, In some respects, the mixing column 2 resembles a distillation column operated in reverse. It should be noted however that a distillation column has one feed and two outputs (e.g. an air feed and an oxygen output and a nitrogen output) wheras the mixing column or heat pump illustrated in FIG. 1 has two feeds (liquid oxygen and gaseous nitrogen) and one output (air).

In general, it is desirable to operate the mixing column 2 with a relatively large number of trays (for example 20 to 60) in order to obtain a greater efficiency in the recovery of the work of mixing. Such greater recovery is made possible when more and more trays are employed as when the device approaches more closely to a theoretical reversible mixer from which all the work of mixing can be recovered but which has an infinite number of trays. In designing a practical mixer, there comes a point where the advantage of adding additional trays is outweighed by the additional pressure drop that these trays cause. Only a relatively few trays, though, are required to give relatively pure oxygen at the top of the column 2 and in the condenser 20 and relatively pure nitrogen at the bottom of the column 2 and in the reboiler 24. This regime gives a relatively large condenser to reboiler temperature difference but the thermal load that can be placed on the heat pump is low. If a higher thermal load is placed on the column there will be considerable loss of purity of the oxygen and nitrogen at the respective ends of the column and in the condenser and reboiler, consequently reducing the temperature span of the heat pump.

In one example of the operation of the apparatus shown in FIG. 1 the ratio of the flows of oxygen through the conduit 16 and air through the outlet 30 may be in the range of 0.21:1–0.79:1. The liquid vapour ratio at the top of the mixing column is approximately 0.23.

Figure 2:
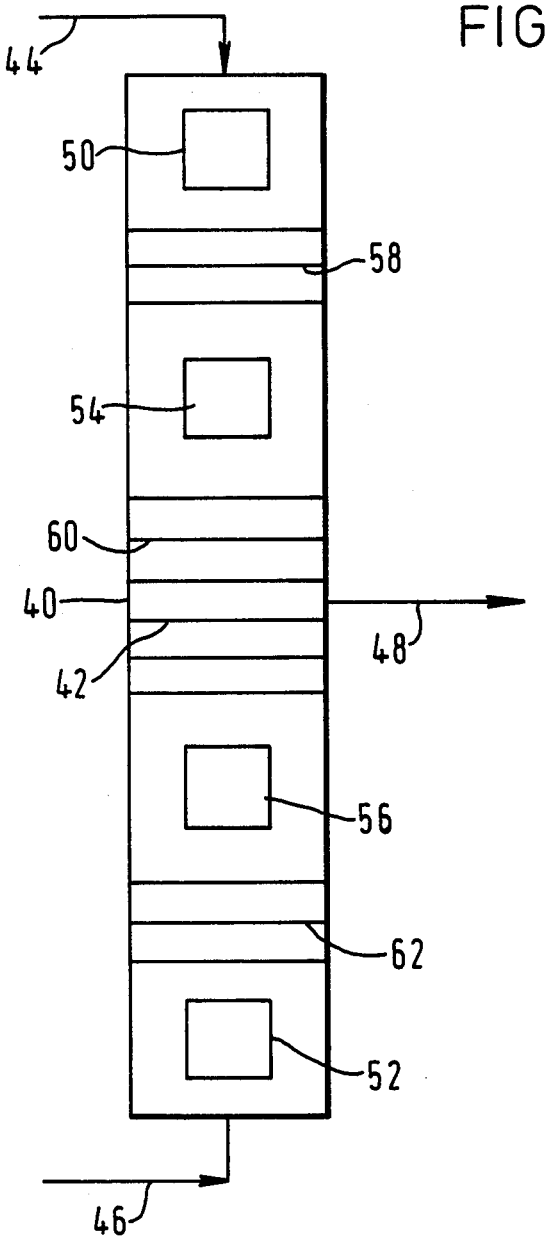
FIG. 2 is a schematic diagram illustrating modifications to the column shown in FIG. 1.

A modification to the column 2 of FIG. 1 is illustrated schematically in FIG. 2. Referring to FIG. 2, the column 40 illustrated with inlets 44 and 46 and outlet 48, performs the same function as the column shown in FIG. 1 but is illustrated in a slightly different manner. It has a plurality of vertically spaced, horizontal, liquid-vapour contact trays 42. At the top of the column above all the trays 42 is a condenser 50 which is able to create a flow of liquid oxygen down the column. At the bottom of the column below the level of the lowermost tray in the column 40 is a reboiler 52 which boils liquid nitrogen at the bottom of the column and thus creates a flow of vapour up the column.

The column 40 is also provided with an intermediate condenser 54 and an intermediate reboiler 56. There is a first group 58 of trays 42 between the condenser 50 and the condenser 54 and a second group 60 of trays 42 between the intermediate condenser 54 and the intermediate reboiler 56. The outlet 48 for air communicates with the vapour space between a pair of trays in this group 60. There is also a group 62 of trays 42 between the reboiler 56 and the reboiler 52. Operation of the intermediate condenser 54 is effective to reduce the liquid-vapour ratio in the region of the column above the level of the air outlet 48 and below the condenser 54 to a value less than that which obtains at the top of the column 40. Thus then liquid-vapour ratio associated with the group 58 of trays may be 8 and that associated with those of the group 60 above the level of the outlet 48 may be about 3.57. The reboiler 56 operates to increase the liquid-vapour ratio associated with the group 62 of trays. For example, the liquid-vapour ration associated with the group 62 of trays may be 0.23 and that associated with those of the group 60 below the level of the outlet 48 may be 0.32. It is believed that by using such an intermediate condenser and such intermeidate reboiler the efficiency of the heat pump can be increased from about 65% to about 75% at one atmosphere. It is believed that further increases in efficiency may be achieved if higher operating pressures are employed.

An alternative to the use of the intermediate condenser 54 and he intermediate boiler 56 is to withdraw a crude vaporous oxygen stream at a corresponding level in the column to that of the condenser 54 and to withdraw a crude liquid nitrogen stream from the column at about the level of the intermediate boiler 56.

Referring against to FIG. 1 of the accompanying drawings, it will be seen that the air stream is withdrawn through the outlet 30 from the vapur flow indicated by the arrows 10. If desired, some air may also be withdrawn from the liquid flow indicated by the arrows 12 or indeed all of the air withdrawn may be from the liquid flow. These two alternatives are however not preferred unless adequate use can be made of the enthalpy of condensation of the liquid air.

Figure 3:
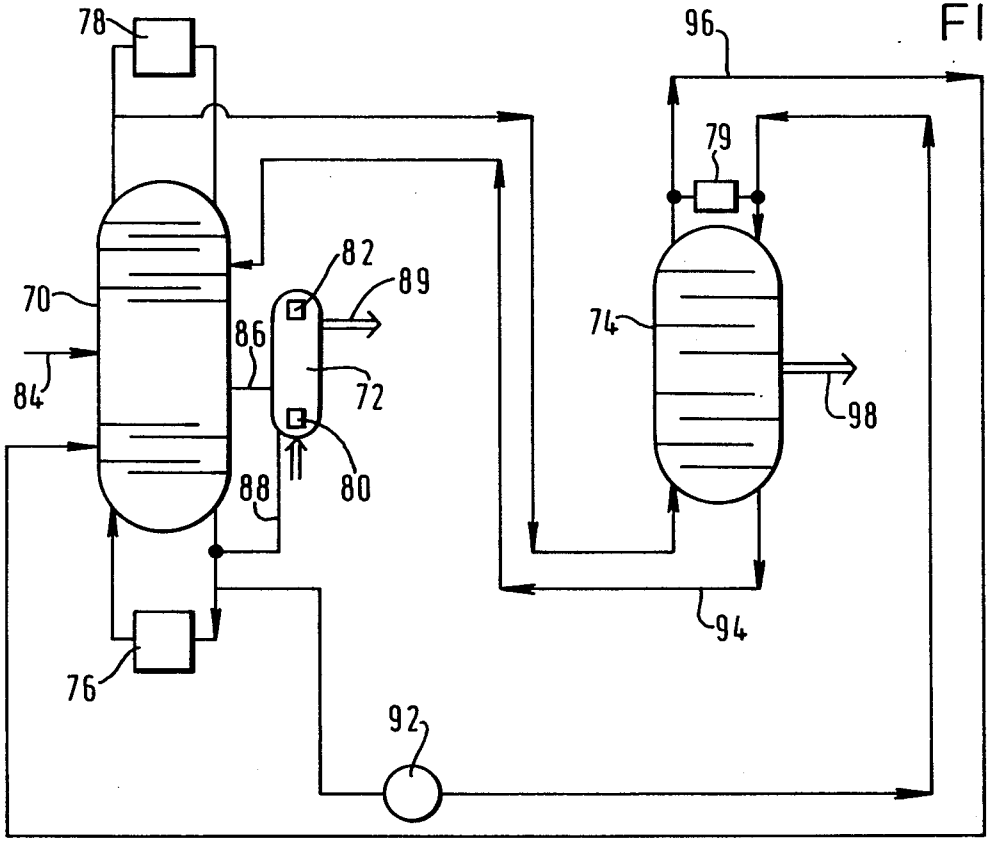
FIG. 3 is a schematic diagram showing a plant for separating argon from air in accordance with the invention.
Figure 4:
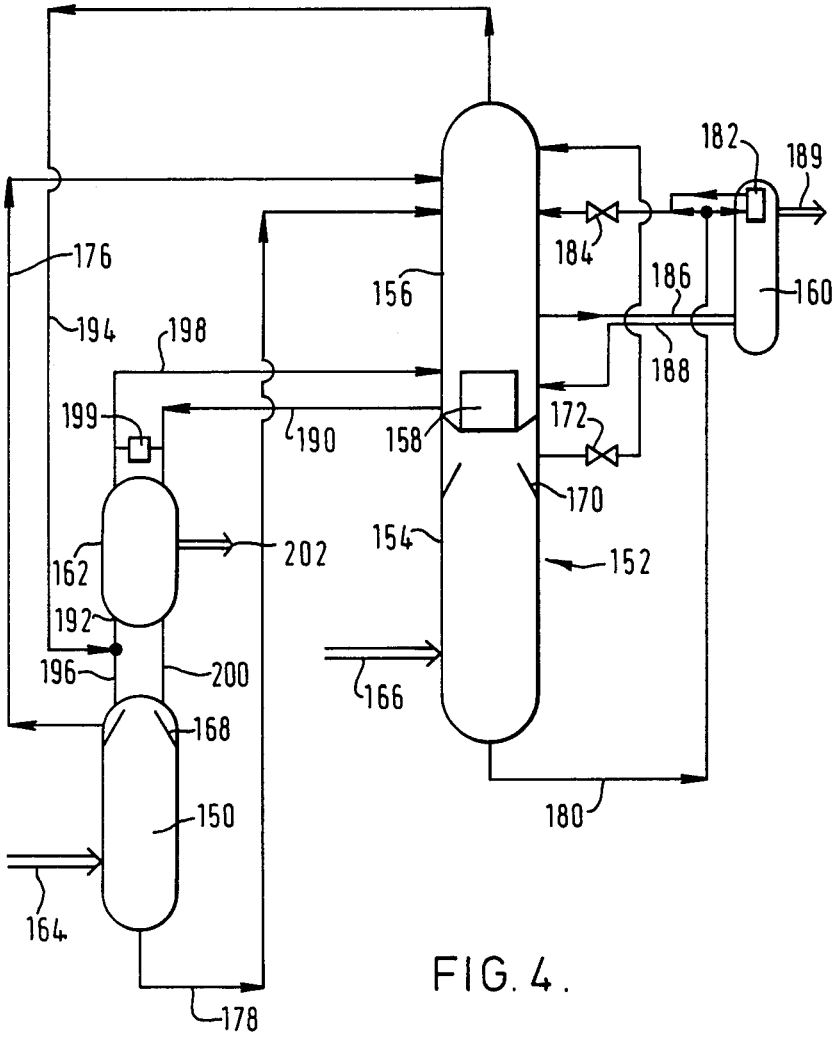
FIG. 4 is a schematic diagram showing another plant for separating argon from air in accordance with the invention.
Figure 5:
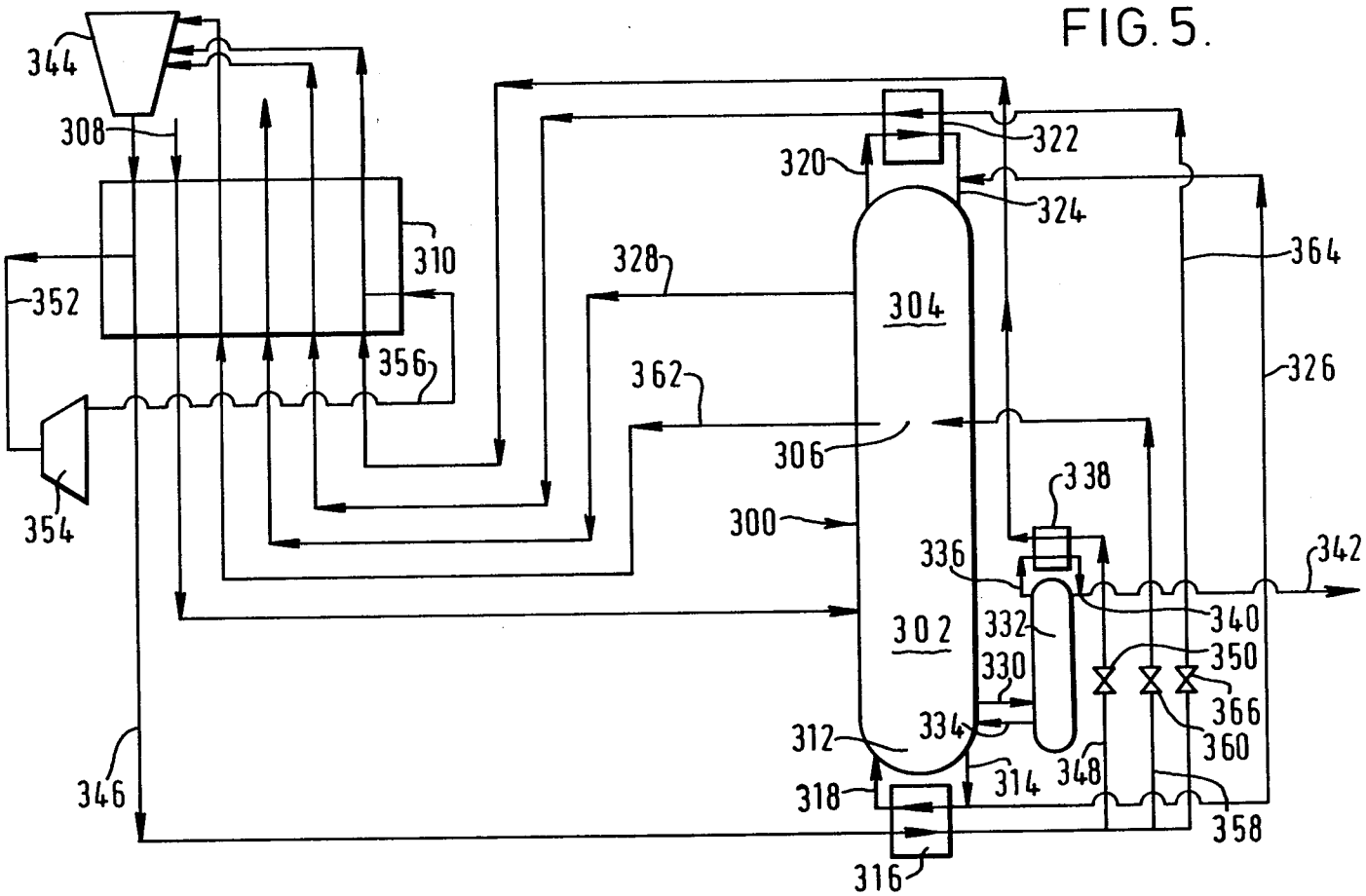
FIG. 5 is a schematic diagram showing a further plant for separating argon from air.

Referring now to FIGS. 3 to 5 of the accompanying drawings, three different plants for the separation of argon from air are illustrated schematically and in a simplified manner so as to facilitate understanding of the invention.

Referring to FIG. 3, the illustrated plant includes a single low pressure distillation column 70 for the fractionation of air, an auxiliary column 72 for obtaining an argon-rich stream from a gaseous fraction taken from the distillation column 70, and a mixing column 74 which functions as a heat pump and helps to reduce the refrigeration requirements for the column 70. The column 70 is provided with a reboiler 76 and a condenser 78. Refrigeration for the condenser 78 and thermal energy for the reboiler 76 may be provided by any conventional means such as a conventional heat pump circuit (not shown). Column 72 is similarly provided with a reboiler 80 and a condenser 82. Again, heating for the rebiler 80 and cooling for the condenser 82 may be provided by conventional means such as a conventional heat pump cycle (not shown).

Air is fed into the distillation column 70 through an inlet 84. The air is typically introduced into the column 70 as a liquid or vapour at a temperature of about 85 K. and a pressure of from 1 to 1.5 atmospheres absolute. The air may be taken from the atmosphere, compressed, purified by removal of particulates, carbon dioxide, water vapour and any hydrocarbons therefrom, and liquefied, all by conventional means that are well known in the art. In the column 70, the air is fractionated. A vapour stream ascends the column 70 and comes into contact with a liquid stream descending the column. Mass exchange takes place between the vapour stream and the liquid stream. The liquid stream becomes progressively warmer as it descends the column and the vapour stream progressively colder as it ascends the column. Accordingly, the vapour stream is enriched in nitrogen as it ascends the column and the liquid stream is enriched in oxygen as it descends the column so that substantially pure liquid oxygen collects at the bottom of the column 70 and substantially pure vaporous nitrogen collects at the top of the column 70. Liquid oxygen collecting at the bottom of the column 70 is reboiled in the reboiler 76 operating at the temperature of 84 K. and a pressure of 1.5 atmospheres absolute and the resulting oxygen vapour is returned to the column to start its ascent therethrough. Nitrogen vapour is withdrawn from the top of column 70 and condensed in the condenser 78 operating at a temperature of 79 K. and a pressure of about 1.5 atmospheres absolute, and the resulting liquid is returned to the top of the column 70 to start its descent down the column.

Dry air typically contains just under 1% by volume of argon. Argon has a volatility greater than that of oxygen but less than that of nitrogen. The fractionation process takes place in the column 70 and causes the argon concentration to vary down the column and it is found that a maximum argon concentration tends to occur at a level little below that at which the air is introduced through the inlet 84. Accordingly, in order to produce an argon-rich product fration, vapour is taken from the region of the distillation column 70 where the argon concentration is at a maximum (typically in the range 10 to 20% by volume) and is passed through a conduit 86 into the auxiliary distillation column 72 where it is fractionally distilled to produce a liquid fraction comprising substantially pure oxygen that collects at the bottom of the column and a vapour fraction, containing at least 95% by volume of argon, that collects in the top of the column. The argon-rich fraction may be withdrawn from the column 72 through an outlet 89 and if desired further purified. The liquid oxygen fraction from the bottom of the column 72 may be returned to the distillation column 70 at an appropriate level through the conduit 88.

A portion of the gaseous nitrogen is taken from the inlet side of the condenser 78 and passed into the bottom of the column 74 which has an arrangement of liquid-vapour contact trays such as that described with respect to the column 2 shown in FIG. 1.

A liquid oxygen stream is withdrawn from the inlet side of the reboiler 76 and is passed through pump 92 and is then introduced into the mixing column 74 at its top. A flow of vapour upwardly through the column and a downward flow of liquid through the column 74 are there established. The bottom of the mixing column 74 operates at a temperature of 79 K. and a pressure of 1.5 atmospheres absolute and the top of the column 74 operates at a temperature of 94 K. and a pressure of 1.2 atmospheres absolute. In the manner described with reference to FIG. 1, the vapour by the time it reaches the top of the column has become relatively pure oxygen (though not as pure as the liquid oxygen that is introduced into the column at the top) and the liquid by the time it has reached the bottom of the column has become relatively pure nitrogen (though not as pure as the gaseous nitrogen that is introduced into the bottom of the column from the inlet side of the condenser 78 of the distillation column 70). The liquid nitrogen stream so formed is returned to the distillation column 70 via a conduit 94. Since the liquid nitrogen stream is not as pure as the gaseous stream withdrawn from the inlet side of the condenser 78 it need not be returned to the top of the column, but instead to a position typically up to a few trays below the top tray in the column 70. Part of the vaporous oxygen collecting at the top of the column 74 is returned via a conduit 96 to the bottom end of the distillation column 70. Since this oxygen is not quite as pure as that withdrawn from the inlet side of the reboiler 76, it may also be introduced typically up to a few trays above the lowest tray in the columne 70. In order to increase the reflux for the mixing column, and to facilitate the maintenance of operating conditions in the mixing column relatively close to equilibrium conditions, a further part of the vaporous oxygen collecting at the top of the column 74 may be condensed in a condenser 97 and the resulting liquid oxygen eturned to the top of the column 74 with the liquid oxygen stream from the distillation column 70, thus reducing the purity of this stream. The mixing column 74 reduces the load on the conventional heat pump cycle or other means used to provide heating for the reboiler 76 and cooling for the condenser 78.

A mixed waste vapour stream consisting essentially of oxygen and nitrogen is vented from the mixing column 74 through an outlet 98 situated at an appropriate level to enable a gas mixture to pass out of the column 74 of a composition whose oxygen to nitrogen ratio is substantially the same as that of the air entering the distillation column 70 through the inlet 84.

As shown in FIG. 3 the above described plant for separating argon from air produces only two "output" streams, namely the argon stream leaving the column 72 through the outlet 89 and the air stream leaving the mixing column 74 through the outlet 98. The plant is therefore used to produce exclusively argon from air. Conventionally, argon is produced as additional product to oxygen and/or nitrogen in a cryogenic distillation system. By using the heat pump according to the present invention to recover the work of mixing, the efficiency of argon production in comparison with that of a conventional cryogenic air separation system may be considerably increased. The invention also encompasses the withdrawal of one or both of a nitrogen product stream and an oxygen product stream from the main distillation column 70, but it is to be appreciated that considerable amounts of oxygen and nitrogen will be vented from the plant shown in FIG. 3 through the outlet 98. In venting the 'air' so rejected from the mixing column 74, use may be made of its low temperature in, for example, providing refrigeration to help refrigerate or liquefy the incoming air upstream of the distillation column 70. Similarly, the argon product stream may also be employed in providing refrigeration for the incoming air.

It is not essential to operate the distillation column 70 at pressures as low as from 1 to 1.5 atmospheres absolute. Typically, a pressure of up to 10 atmospheres may be employed depending on the pressure at which the air feed for the distillation column 70 is available. In addition, it is also possible to operate the column so that a maximum argon concentration occurs in the liquid collecting at the bottom of the column 70 and this liquid is then used as the source of the argon-rich fluid that is further separated in the column 72.

The plant shown in FIG. 3 utilises a single distillation column 70. Efficient separation of air can also be achieved in a double column. A double column for separating air is one in which a higher pressure column has its upper end in heat exchange relation with the lower end of a lower pressure column. Reboil for the upper column and condensation with the lower column is typically provided by a combined reboiler-condenser. An example of a plant according to the invention employing a main distillation column of the double column type is shown in FIG. 4.

Referring to FIG. 4, there is illustrated a distillation system comprising a low pressure column 150, a double column 152 consisting of a high pressure column 154 and a low pressure column 156, there being a common condenser-reboiler 158 placing the lower column 154 in heat exchange relationship with the upper column 156, and an auxiliary column 160 for producing an argon-rich gas. In addition, a mixing column 162 is also provided.

In the plant shown in FIG. 4, the air feed is to the column 150 and to the column 154. The column 150 is fed with vaporous air at a relatively low pressure, say about 1.5 atmospheres absolute, and at a temperature of about 85 K., from an inlet 164. High pressure liquefied air typically under a pressure of about 6 atmospheres absolute and at a temperature a little in excess of 100 K. is passed into the column 154 through an inlet 166. In the column 150 the low pressure air is separated into an oxygen-rich liquid that collects at the bottom of the column 150 and a nitrogen-rich vapour at the top of the column 150 (at a temperature of 79 K.), which vapour is condensed by means which will be described below, the condensate being collected in collector 168 at the top of the column 150, some of which condensate is employed as reflux in the column 150. Similarly, the liquid air introduced into the column 154 thorugh the inlet 166 is separated into an oxygen-rich liquid which collects at the bottom of the column 154 and a substantially pure nitrogen vapour at a temperature of 97 K. at the top of the column, which vapour is condensed in the condenser-reboiler 158 and is collected at the top of the column 154 in a collector 170. Some of the liquid nitrogen so collected is employed as reflux in the column 154. This liquid nitrogen tends to be of greater purity than the liquid nitrogen collected in the column 150. Oxygen-rich and nitrogen-rich liquids produced in the columns 150 and 154 are used to provide reflux for the column 156.

A nitrogen-rich vapour collects at the top of the column 156 at a pressure of 1.2 atmospheres absolute and a temperature of 79 K., and an oxygen-rich liquid collects at the bottom of column 156 under a pressure of 1.5 atmospheres absolute and at a temperature of 94 K.

Relatively pure liquid nitrogen is taken from the collector 170 and expanded through the expansion valve 172 and introduced into the top of the column 156 above the level of the uppermost tray in that column. Liquid nitrogen collecting in the collector 168 of the column 150 is introduced into the column 156 via a conduit 176 at a level below that at which the expanded liquid nitrogen from the column 154 is introduced, the level of introduction of liquid nitrogen from column 150 being selected in accordance with its purity. Alternatively, the liquid may be supplied to the top of the column 156. Liquid collecting at the bottom of column 150 is passed through a conduit 178 into the column 156 at a level below that at which the liquid nitrogen from the conduit 176 enters the column. Liquid collecting at the bottom of column 154 is taken from that column and passed through a conduit 180. A part of this liquid is used to cool a condenser 182 situated at the top of the column 160. After passing through the condenser 182 this portion of the liquid is reunited with the remainder of the liquid and is then expanded through valve 184 into the column 156 as reflux liquid at an appropriate level selected according to the composition of the liquid.

In the operation of the double column 150 the combined condenser-reboiler 158 provides the necessary reflux for the lower column 154 and the necessary reboil for the column 156.

The column 160 is operated to produce an argon-rich product gas stream typically containing up to 98% by volume of argon. A stream typically containing from 10 to 20% by volume of argon is taken from the column 156 at a level where the concentration of argon in the vapour phase is at a maximum and is passed through a conduit 186 into the column 160 at a level below the bottom tray of the column 160. In the column 160 the vapour feed is separated into an argon-rich vapour which is withdrawn from above the level of the uppermost tray in the column through an outlet 189 and an oxygen-rich liquid which is returned to the column 156 at an appropriate level via a conduit 188.

The possibility of using some low pressure air in the distillation system shown in FIG. 4 is created by the use of the mixing column 162 to perform heat pump duty, thereby to provide liquid reflux for the column 150. Thus, relatively pure liquid oxygen collecting at the bottom of the column 156 is passed therefrom through the conduit 190 into the top end of the mixing column 162. A stream of relatively pure gaseous nitrogen is supplied through inlet 192 to the bottom of the mixing column 162 and this stream is formed by uniting a first stream of relatively pure vaporous nitrogen taken from the top of the column 156 and passed through a conduit 194 with a stream of nitrogen taken from the top of the column 150 and passed through a conduit 196 in which the conduit 194 terminates. Vapour ascends the mixing column 162 and comes into mass exchange relationship with liquid descending the mixing column 162. As a result of this mass transfer, the liquid by the time it reaches the bottom of the column 162 comprises liquid nitrogen containing a minor proportion of impurity and the vapour reaching the top of column 162 consists of oxygen with a minor proportion of impurity. Oxygen vapour may be returned to the column 156 at a temperature of 94 K. via a conduit 198, being introduced at a level typically a little above that from which the liquid oxygen is withdrawn through the conduit 190. In order to increase the reflux for the mixing column, and to facilitate the maintenance of operating conditions in the mixing column relatively close to equilibrium conditions, a condenser 199 is employed to condense a part of the gaseous oxygen stream withdrawn from the top of the mixing column 162, and the resulting liquid oxygen is returned to the top of the column 162, thus reducing the purity of the reflux provided to that column. Liquid nitrogen that reaches the bottom of the column 162 is passed through conduit 200 into the top of the column 150 at a temperature of 79 K. and thus provides the aforementioned liquid that collects in the collector 168 from which reflux streams for the column 150 and 156 are formed.

A mixed waste whose ratio of oxygen to nitrogen is substantially the same as that of the air introduced into the columns 150 and 154 (for separation) is passed out of the column 162 through the outlet 202 and may be used to provide refrigeration, for example, in liquefying the air supplied to the inlets 164 and 166 of the columns 150 and 154 respectively.

The mixing column 162 in supplying liquid nitrogen reflux to the distillation columns 150 and 156, and taking gaseous nitrogen from these columns is in effect withdrawing heat from the columns, and in taking liquid oxygen from the column 156 and returning oxygen vapour to that column is in effect supplying heat to that column. Since the bottom of the column 156 is at a higher temperature than either the top of column 150 or the top of the column 156, the mixing column 162 is acting as a heat pump. This heat pumping action enables more of the air for separation to be taken at the relatively low pressure of about one and a half atmospheres absolute instead of the relatively high pressure of 6 atmospheres.

In order to facilitate transfer of fluids between the various low pressure columns in the plant shown in FIG. 4 pumps may be employed as desired.

The plant shown in FIG. 4 produces exclusively an argon product typically containing up to 98% by volume of argon. By operating a plant such as that shown in FIG. 4 we believe that it is possible to obtain an argon separation having an efficiency of up to about 3%. This compares with the 1.5% efficiency generally achieved in conventional cryogenic air separation plants which have an argon "side column". If desired one or both of an oxygen product and nitrogen product may be taken from the column 156, although it should be borne in mind that both oxygen and nitrogen are vented from the plant through the outlet 202 as a waste stream.

In FIG. 5 of the accompanying drawings, we illustrate how gaseous nitrogen may be taken from the distillation zone and used as the working fluid in a heat pump cycle providing reboil for a main distillation zone and reflux for the main distillation zone, reflux for an auxiliary distillation zone from which a pure argon product is obtained, and reflux for a mixing zone.

Referring to FIG. 5, the illustrated plant includes a single main column 300 having a lower distillation zone 302 contiguous with an upper mixing zone (or region) 304. There is a level 306 in the column at which a maximum nitrogen purity obtains in both the gaseous and liquid phases and this level 306 therefore represents the interface between the distillation zone 302 and the mixing zone 304.

An incoming air stream 308 which has been purified by conventional means to remove relatively high boiling point impurities including constituents such as water vapour and carbon dioxide, is passed at a rate of 1000 $SM^3$/hr through a heat exchange block 310 and the purified air is thereby reduced in temperature to a value just above that at which it would begin to condense. The resulting fluid stream at a temperature of 86 K. and a pressure of 1.5 atmospheres absolute and having a composition of 78.07% nitrogen, 0.93% argon and 21% oxygen is introduced into the distillation zone 302 at an intermediate level thereof. The air is fractionated in the zone 302. A liquid becoming progressively richer in oxygen flows down the zone and a vapour becoming progressively richer in nitrogen ascends the zone. Liquid oxygen collects in a sump 312. Liquid oxygen (comprising 99.9% and 0.1% argon) passes out of the sump 312 through an outlet 314 and a part of it is reboiled in a reboiler 316 and is returned to the bottom of the column 302 through an inlet 318.

The remainder of the liquid oxygen is withdrawn through the outlet 314, passes through conduit 326, and is introduced into the top of the mixing zone 304. Liquid descends the zone 304 and undergoes mass transfer with a vapour stream ascending from the distillation zone 302 into the mixing zone 304. As a result of this mass exchange, a vapour rich in oxygen passes to the top of the column 300 where the composition of the vapour is such that it contains 84% by volume of oxygen and less than 0.1% by volume of argon. Some of the oxygen-rich vapour is taken from the top of the column 300 through an outlet 320 and is condensed in a condenser 322 and is then returned to the top of the colimn 300 through a conduit 324 which has a union with the conduit 326. The liquid oxygen condensate enhances the reflux provided to the mixing zone 304. The stream of liquid oxygen entering the top of the column 300 comprises a mixture of the oxygen-rich vapour condensed in the condenser 322 and the liquid oxygen from the conduit 326. The composition of this stream is such that it comprises 95% by volume of oxygen and less than 0.1% by volume of argon. In turn, the mixing zone 304 provides some of the requirements for liquid nitrogen reflux of the distillation zone 302. The remainder of the reflux requirements for this zone 302 are met by introducing liquid nitrogen at the level 306 from a conduit 358 at a flow rate of 420 $SM^3$/hr and a temperature of 80 K. The way in which the liquid nitrogen for the conduit 358 is formed will be described below.

A waste air stream 328 including 21% oxygen and less than 0.1% argon is withdrawn from an intermediate level of the mixing zone 304 at a pressure of 1.25 atmospheres absolute and a flow rate of 991.1 $SM^3$/hr and is vented to the atmosphere after being passed through the heat exchanger 310 countercurrently to the incoming air stream 308 and is thus warmed to a temperature of 297 K.

Typically, the distillation zone 302 is operated such that substantially no argon leaves said zone other than through a conduit 330 located in communication with a vapour space in the distillation zone 302 at a level intermediate that of the inlet for air and the bottom tray (not shown) in the column. The stream withdrawn through the conduit 330 is relatively rich in argon and is introduced into an auxiliary distillation column 332 in which it is fractionated into an argon product which collects at the top of the column 332, and which is withdrawn at a rate of 8.9 $SM^3$/hr through conduit 342, and an oxygen-rich liquid which is returned to the column 302 via a conduit 334. Reflux for the column 332 is provided by taking argon from the top of the column 332 (via outlet 336) column and condensing it in a condenser 338, the resultant liquid argon being returned to the top of the column 332 through a conduit 340.

A heat pump circuit is operated in order to provide heating for the reboiler 316 and cooling for the condensers 322 and 338. Thus, a stream of nitrogen gas (or vapour) having the composition 98.8.% $N_2$, 1% $O_2$ and 0.2% Ar is withdrawn from the level 306 of the column 300 at a rate of 420 $SM^3$/hr and a temperature of 80 K. and passes into conduit 362, whereby it is conducted through the heat exchanger 310 countercurrently to the flow of the incoming air stream 308 and then enters an inlet of the compressor 344 at a temperature of 297 K. Compressed nitrogen is withdrawn from the compressor 344 at a rate of 958 $SM^3$/hr, a pressure of 6.8 atmospheres absolute, and a temperature of 300 K. and is introduced into a conduit 346 that conveys the nitrogen gas through the heat exchanger 310 concurrently with the stream 308 thereby cooling the nitrogen to a temperature of 97.7 K. Downstream of the cold end of the heat exchanger 310 nitrogen passes through the reboiler 316 at a rate of 708 $SM^3$/hr and a pressure of 6.57 atmospheres absolute and is condensed therein as it boils the liquid oxygen. The resulting liquid nitrogen is then divided into three separate streams. A first stream passes at a rate of 200 $SM^3$/hr into a conduit 348 and is then expanded through a valve 350. The resulting fluid is employed to provide cooling for the condenser 338 associated with the auxiliary column 332. A gaseous nitrogen stream thus leaves the condenser 338 at a temperature of 89.9 K. and pressure of 1.5 atmospheres absolute and is returned to the compressor 344 passing en route through the heat exchanger 310 countercurrently to the flow of the stream 308, thus being warmed to a temperature of 297 K.

A second stream of liquid nitrogen is taken from the reboiler 316 and is passed at a rate of 420 $SM^3$/hr into a conduit 358 in which is located an expansion valve 360 through which the liquid nitrogen is expanded. The resulting liquid nitrogen at a temperature of 80 K. forms part of the reflux for the distillation zone 302, being introduced into the column 300 at the level 306 as aforesaid.

A third stream of liquid nitrogen from the reboiler 316 passes at a rate of 88 $SM^3$/hr into a conduit 364 in which it is expanded through a valve 366. The liquid nitrogen leaving the expansion valve 366 is then passed through the condenser 322 and thus provides cooling for the condenser 322. The liquid nitrogen itself is thus vaporised and the resulting vapour at a pressure of 3.5 atmospheres of 86.5 K. is returned through the heat exchanger 310 countercurrently to the incoming air stream 308 and from the warm end of the heat exchanger 310 re-enters the compressor 344 at a temperature of 297 K.

In order to provide refrigeration for the heat exchanger 310, a stream of compressed nitrogen at a rate of 250 $SM^3$/hr is withdrawn from the conduit 346 intermediate location of the heat exchanger 310, is passed through conduit 352, and is expanded in an expansion turbine 354 with the performance of external work. The resulting work-expanded nitrogen at a temperature of 130 K. and a pressure of 1.5 atmospheres is returned to the gaseous nitrogen stream passing through the conduit 348 at an appropriate region the heat exchanger 310.

The operation of the mixing zone 304 provides, in effect, heat pumping work for the distillation zone 302 and thus reduces the overall amount of heat pumping work that needs to be done for the process as a whole. It is therefore possible to produce argon at an exceptionally low specific power consumption.

The percentages in the example above are all percentages by volume.

Improvements may be made to the plant shown in FIG. 5. In particular, the column 300 may be operated at higher pressures and intermediate reboil and intermediate condensation may be provided for the mixing zone 304 (see FIG. 2) in order to reduce the specific power consumption of which argon is produced.

I claim:

1. Apparatus for separating argon from a gas mixture comprising oxygen, nitrogen and argon, comprising means defining a plurality of distillation zones, an inlet to at least one of said distillation zones for a gaseous mixture comprising oxygen, nitrogen and argon, an outlet for argon product from at least one of said distillation zones, means defining a liquid-vapour contact and mixing zone having a relatively warm end spaced from a relatively cold end, a first inlet, communicating with at least one of the distillation zones, for a vaporous nitrogen stream , spaced from a second inlet, communicating with at least one of the distillation zones, for a liquid oxygen stream, an outlet from said liquid-vapour contact and mixing zone intermediate of said inlets for the withdrawal of a mixed waste stream containing both oxygen and nitrogen, liquid-vapour contact means in said liquid-vapour contact and mixing zone which enable there to be established through the zone a flow of fluid that becomes in the direction of liquid flow progressively richer in nitrogen through mass exchange with an opposed flow of vapour that becomes in the direction of vapour flow progressively richer in oxygen, means for employing fluid in or from said liquid-vapour contact and mixing zone to provide heat transfer for the distillation of the said gaseous mixture, whereby some of the work of mixing that takes place in said contact and mixing zone in operation of the apparatus is recovered, means for passing a third fluid stream comprising vaporous oxygen from the relatively warm end region of the said liquid-vapour contact and mixing zone to one of the distillation zones means for condensing vaporous oxygen from the relatively warm end of said liquid-vapour contact and mixing zone and returning the condensate to the contact and mixing zone.

2. In a process for the separation of argon from a gaseous mixture comprising argon, nitrogen and oxygen by fractional distillation in a plurality of distillation zones, the improvement comprising introducing a vaporous nitrogen stream and a liquid oxygen stream from one or more of said zones into different regions of a liquid-vapour contact and mixing zone having a relatively warm end and a relatively cold end, establishing a liquid flow and an opposed vapour flow through said contact and mixing zone which become progressively richer in nitrogen and oxygen, respectively, through mass exchange, condensing vaporous oxygen from the warm end of said contact and mixing zone and returning it to said zone, removing a mixed waste stream containing both oxygen and nitrogen from an intermediate point of said contact and mixing zone and utilizing fluid from said contact and mixing zone to provide heat transfer in said process.

3. A process according to claim 1, in which the mixed waste stream is withdrawn from an intermediate level of the mixing zone.

4. A process according to claim 2, additionally including the steps of reboiling liquid at the colder end of the contact and mixing zone and returning the resultant vapour to said zone.

5. A process according to claim 2, in which condensation of the said vaporous oxygen is employed to provide reboil for at least one of the distillation zones.

6. A process according to claim 2, wherein separation of the gaseous mixture comprising oxygen, nitrogen and argon is carried out in a single or double distillation zone which produces oxygen at its bottom and nitrogen at its top, wherein a stream comprising argon and oxygen is withdrawn from an intermediate level of said distillation zone, the argon content of said stream being greater than that of said gaseous mixture, and wherein said argon-oxygen stream is fractionated in a separate distillation zone to produce a pure argon product.

7. A process according to claim 2, in which the ratio of nitrogen to oxygen in the mixed waste stream is substantially the same as the ratio of nitrogen to oxygen in the said gaseous mixture.

8. A process according to claim 2, in which the ratio of oxygen to nitrogen in the mixed waste stream is greater than the ratio of oxygen to nitrogen in the said gaseous mixture.

9. A process according to claim 2, in which the liquid-vapour contact and mixing zone operates at an average pressure in the range of from atmospheric pressure to 12 atmospheres.

10. A process according to claim 2, in which the purity of the condensed oxygen is less than that of the liquid oxygen stream.

11. A process according to claim 2, in which the vaporous nitrogen stream passes from the top of a distillation zone to the cold end of the contact and mixing zone and a liquid nitrogen stream passes from the contact and mixing zone to the top of said distillation zone, thereby providing reflux for said distillation zone.

12. In a process for the separation of argon from a gaseous mixture comprising argon, nitrogen and oxygen by fractional distillation in a plurality of distillation zones, the improvement comprising introducing a vaporous nitrogen stream and a liquid oxygen stream from one or more of said zones into different regions of a liquid-vapour contact and mixing zone having a relatively warm end and a relatively cold end, establishing a liquid flow and an opposed vapour flow through said contact and mixing zone which become progressively richer in nitrogen and oxygen, respectively, through mass exchange, withdrawing oxygen vapor from the warm end of the contacting and mixing zone and introducing it to at least one of said distillation zones, withdrawing a mixed waste stream containing both oxygen and nitrogen from an intermediate point of said contact and mixing zone and utilizing fluid from said contact and mixing zone to provide heat transfer in said process.

13. A process according to claim 12, wherein separation of the gaseous mixture comprising oxygen, nitrogen and argon is carried out in a single or double distillation zone which produces oxygen at its bottom and nitrogen at its top, wherein a stream comprising argon and oxygen is withdrawn from an intermediate level of said distillation zone, the argon content of said stream being greater than that of said gaseous mixture, and wherein said argon-oxygen stream is fractionated in a separate distillation zone to produce a pure argon product.

14. A process according to claim 12, in which the ratio of nitrogen to oxygen in the mixed waste stream is substantially the same as the ratio of nitrogen to oxygen in the said gaseous mixture.

15. A process according to claim 12, in which the ratio of oxygen to nitrogen in the mixed waste stream is greater than the ratio of oxygen to nitrogen in the said gaseous mixture.

* * * * *